US011139136B1

(12) United States Patent
Scheckelhoff et al.

(10) Patent No.: US 11,139,136 B1
(45) Date of Patent: Oct. 5, 2021

(54) FUSE HOLDER WITH BUSBAR CLAMP

(71) Applicants: Robert Scheckelhoff, Perrysburg, OH (US); Paul Scott Buskey, Waterville, OH (US); Joseph Brown, Waterville, OH (US)

(72) Inventors: Robert Scheckelhoff, Perrysburg, OH (US); Paul Scott Buskey, Waterville, OH (US); Joseph Brown, Waterville, OH (US)

(73) Assignee: Regal Beloit America, Inc., Beloit, WI (US)

( * ) Notice: Subject to any disclaimer, the term of this patent is extended or adjusted under 35 U.S.C. 154(b) by 0 days.

(21) Appl. No.: 16/888,683

(22) Filed: May 30, 2020

(51) Int. Cl.
*H01H 85/54* (2006.01)
*H01H 85/20* (2006.01)
*H01H 85/02* (2006.01)

(52) U.S. Cl.
CPC ..... *H01H 85/545* (2013.01); *H01H 85/0208* (2013.01); *H01H 85/205* (2013.01); *H01H 2085/2055* (2013.01)

(58) Field of Classification Search
CPC ..... H01H 85/545; H01H 85/205; H01H 85/0208; H01H 2085/2055; H01H 85/2045; H01R 4/38
USPC ..... 337/186, 194, 208, 216, 227, 255, 259
See application file for complete search history.

(56) References Cited

U.S. PATENT DOCUMENTS 5,355,274 A * 10/1994 Marach ..... H01H 85/306 361/103
5,879,203 A * 3/1999 Egle ..... H01H 85/202 439/830
5,969,587 A * 10/1999 Combas ..... H01H 85/545 335/132
6,759,939 B2 * 7/2004 Sudan ..... H01H 11/0031 337/208
8,310,333 B2 11/2012 Ventura et al.
9,136,083 B2 9/2015 Brakefield et al.
9,384,930 B2 * 7/2016 Lu ..... H01H 85/545
10,049,846 B2 8/2018 Brakefield
10,892,131 B2 * 1/2021 Andaluz Sorli ..... H01H 85/165
2005/0230231 A1 * 10/2005 Kadan ..... H01H 9/0264 200/51 R (Continued)

FOREIGN PATENT DOCUMENTS

EP 1531519 A1 * 5/2005 ..... H01R 4/363

OTHER PUBLICATIONS

Belin, Yves; Vanzetto, Daniel, "Electrical terminal and electrical protection apparatus containing such a terminal", May 18, 2005, Schneider Electric IND SAS, Entire Document (Translation of EP 1531519). (Year: 2005).*

*Primary Examiner* — Stephen S Sul
(74) *Attorney, Agent, or Firm* — Reinhart Boerner Van Deuren P.C.

(57) ABSTRACT

A fuse holder that includes a housing, which has a rotating fuse carrier that rotates about a pivot point between open and closed positions. The fuse carrier is configured to accept insertion of a fuse when in the open position, and configured to bring the fuse into electrical contact with a first and a second fuse clip when in the closed position. Additionally, the fuse carrier, when in the closed position, is further configured to orient the fuse so that the fuse is positioned more vertically than horizontally. In particular embodiments of the invention, the fuse carrier rotates about a pivot located in the housing.

10 Claims, 3 Drawing Sheets

(56) References Cited

U.S. PATENT DOCUMENTS

| | | | | |
|---|---|---|---|---|
| 2005/0285710 | A1* | 12/2005 | Buettner | H01H 85/545<br>337/231 |
| 2008/0048819 | A1* | 2/2008 | Darr | H01H 85/30<br>337/206 |
| 2010/0019879 | A1* | 1/2010 | Darr | H01H 85/203<br>337/227 |
| 2012/0298490 | A1* | 11/2012 | Buttner | H02B 1/052<br>200/303 |
| 2013/0133716 | A1* | 5/2013 | Buettner | H01L 31/05<br>136/244 |
| 2013/0187747 | A1* | 7/2013 | Reibke | H01H 85/202<br>337/213 |
| 2017/0365436 | A1* | 12/2017 | Brakefield | H01H 85/25 |
| 2019/0269026 | A1* | 8/2019 | Aubert | H05K 5/0217 |
| 2019/0386405 | A1* | 12/2019 | Niestrat | H01R 4/42 |

* cited by examiner

FUSE HOLDER WITH BUSBAR CLAMP

FIELD OF THE INVENTION

The invention relates generally to electrical transmission equipment and, more specifically, to a fuse holder for use in electrical circuits for example those circuits used in electrical transmission equipment.

BACKGROUND OF THE INVENTION

Fuses are regularly used in electrical circuits to provide protection for electrical components from electrical overloads. Fuses are for example used in electrical transmission equipment to provide protection for electrical components from electrical surges originating from the power line or from excessive electrical loads. Replaceable fuses are often used. These replaceable fuses are often placed in electrical or fuse boxes. The electrical or fuse boxes may be located where they are not easily accessed and may be mounted in any orientation where space permits.

These replaceable fuses are consumed and provide an open circuit when exposed to a sufficient overload. Such replaceable fuses need to be replaced once consumed. Access to such replaceable fuses in electrical or fuse boxes is often difficult, particularly when the fuse box is located in a poorly accessible location.

A fuse holder is disclosed in U.S. Pat. No. 8,310,333, which describes a modular photovoltaic fuse holder, and in U.S. Pat. No. 9,136,083, which discloses an enclosed bus bar fuse holder. Additionally, U.S. Pat. No. 10,049,846 discloses a fuse holder having a fuse shuttle. The teachings and disclosures of the aforementioned patents are incorporated herein by reference in their entireties.

Panels have limited available space with most of it being height. Many conventional photovoltaic fuse holders are horizontal, which can take up a significant amount of panel space, but leaves a lot of open space vertically. As the wire size in photovoltaic applications continues to increase, the amount of available panel space continues to decrease. As such, fuse holders that make the best use of the available panel space are needed.

It would therefore be desirable to have a fuse holder that addresses at least some of the aforementioned problems. Embodiments of the invention provide such a fuse holder. These and other advantages of the invention, as well as additional inventive features, will be apparent from the description of the invention provided herein.

BRIEF SUMMARY OF THE INVENTION

In one aspect, embodiments of the invention provide a fuse holder that includes a housing, which has a rotating fuse carrier that rotates about a pivot point between open and closed positions. The fuse carrier is configured to accept insertion of a fuse when in the open position, and configured to bring the fuse into electrical contact with a first and a second fuse clip when in the closed position. Additionally, the fuse carrier, when in the closed position, is further configured to orient the fuse so that the fuse is positioned more vertically than horizontally. In particular embodiments of the invention, the fuse carrier rotates about a pivot located in the housing.

In a particular embodiment, the housing is assembled from two halves. In a more particular embodiment, the two halves are joined by one of ultrasonic welding, an adhesive, and one or more mechanical fasteners. Certain embodiments of the fuse holder include a busbar clamp sub-assembly, which includes a screw threaded into a clamp frame, a spring plate, and a spring plate disposed between the screw and one of the first and second fuse clips.

The fuse holder may also include a DIN rail mount attached to a bottom edge of the housing. In other embodiments, the fuse holder include a box lug terminal sub-assembly having a screw threaded into a box lug, and a relief pad disposed between the screw and one of the first and second fuse clips.

In a further embodiment, the fuse carrier includes a first snap rib that engages with a snap feature to keep the fuse carrier in the open position. Further, the fuse carrier may a second snap rib that engages with a snap feature to keep the fuse carrier in the closed position.

In a particular embodiment, at least one of the first and second fuse clips includes a locating and retaining feature configured to fix a location of the fuse clip having the locating and retaining feature. The locating and retaining feature may be in the form of a notch configured to engage with a projection on the housing.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in the figures as an 80-ampere photovoltaic fuse holder for a vertically held fuse that incorporates a busbar clamp. It is envisioned that embodiments of the invention would be suitable for a variety of fuse types, including but not limited to 22 mm×58 mm cartridge fuses. As will be shown below, one of the features included in embodiments of the invention is the ability to accommodate a photovoltaic 80-ampere cartridge fuse while saving panel space by having a vertically-oriented fuse.

In the context of this application, the fuse is considered to be in a "vertical" orientation when the end-to-end alignment (e.g., think of a longitudinal axis through the two ends of the fuse) of the fuse is perpendicular to the length-wise orientation of a DIN rail to which the fuse holder is mounted. The fuse is considered to be in a "horizontal" orientation when the end-to-end alignment of the fuse is parallel to the length-wise orientation of a DIN rail to which the fuse holder is mounted. Furthermore, it is envisioned that embodiments of the fuse holder described herein would be suitable for use in a solar combiner panel constructed for voltages up to 1,500 volts and for electrical currents up to 80 amperes.

Figure 1:
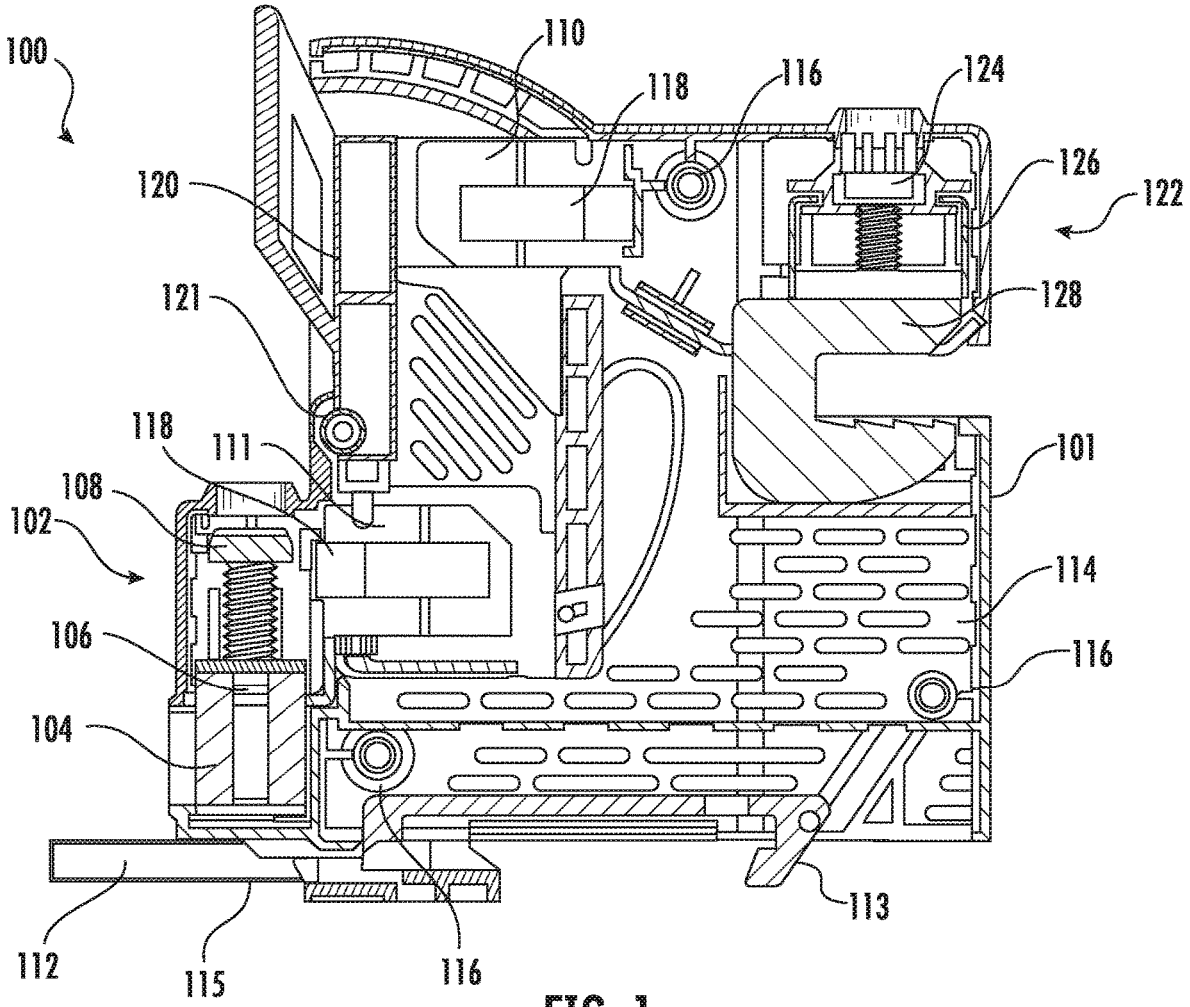
FIGS. 1 and 2 are cross-sectional views of a fuse holder with busbar clamp, constructed in accordance with an embodiment of the invention.
Figure 2:
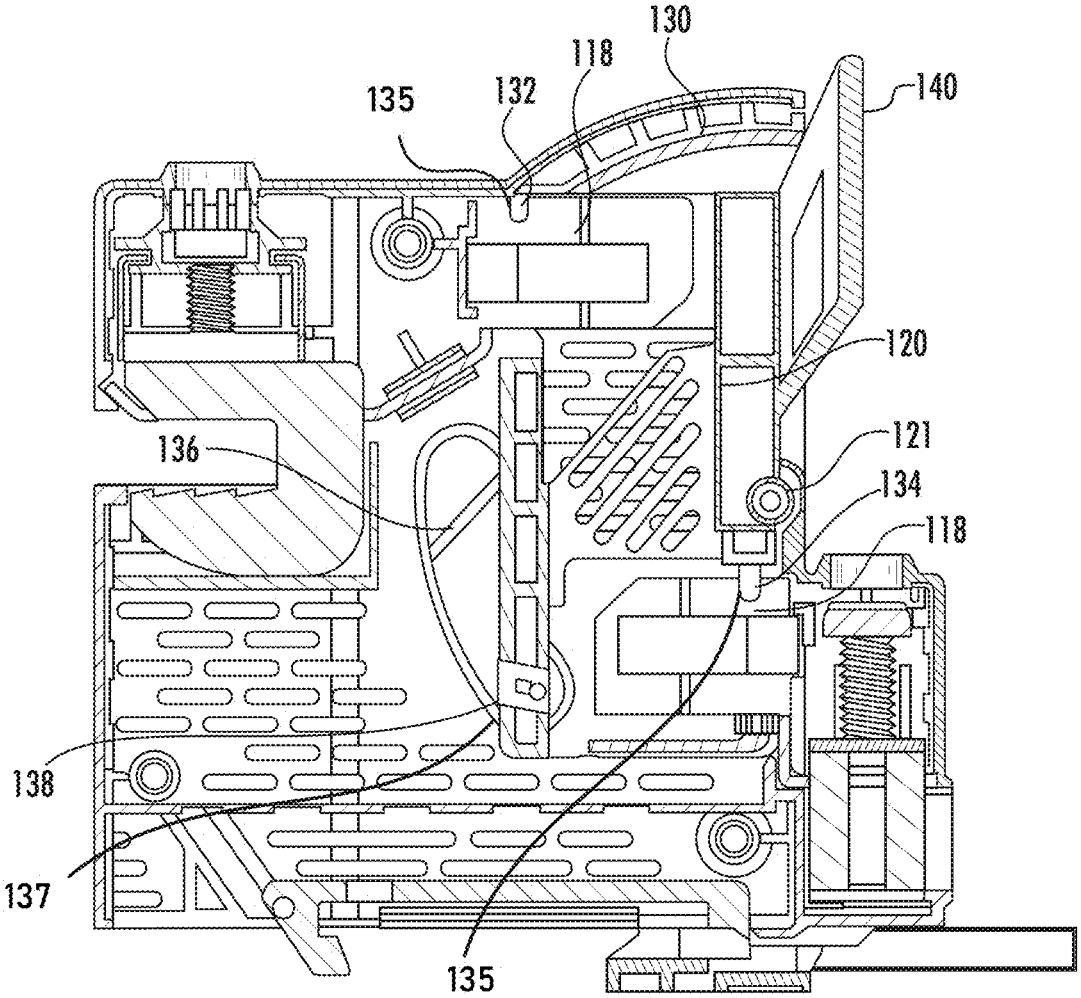

FIGS. 1 and 2 are cross-sectional views of a fuse holder 100, constructed in accordance with an embodiment of the invention. The fuse holder 100 includes a housing 101 in which the components of the fuse holder 100 are disposed. On one side of the housing 101, the fuse holder 100 has a box lug terminal sub-assembly 102 with a box lug 104, a relief pad 106, and a screw 108. The screw 108 and the box lug 104 are threaded together. In at least one embodiment, the box lug terminal sub-assembly 102 accepts a wire range of #1-18 AWG wire.

When the screw 108 is torqued, it pulls up the box lug 104, which clamps the wire to the bottom, or second, fuse clip 111 to create an electrical connection. The relief pad 106 prevents the screw 108 from digging into the second fuse clip 111.

In the embodiment of FIGS. 1 and 2, the fuse holder 100 includes a DIN rail mount 112 assembled along a bottom edge of the fuse holder housing 101, wherein the DIN rail mount 112 has a DIN clip 113 pivotally attached to an outer case 115. As configured, the DIN rail mount 112 pushes in and pulls out (moving from left to right in FIG. 1), traveling between the locked and unlocked positions. When pulled into the locked position, the fuse holder 100 mounts securely onto a DIN rail (not shown). When pushed out, the DIN rail mount 112 travels up into the housing 101 of the fuse holder 100, which allows for the fuse holder 100 to slide easily off the DIN rail.

In a particular embodiment, the housing 101 includes a casing 114 which, in the embodiment of FIGS. 1 and 2, is assembled from two halves houses various internal components of the fuse holder 100. In particular embodiments, the two halves of the casing 114 are joined, for example by ultrasonic welding, adhesive bonding, or mechanical fasteners such as rivets, screws, clamps, etc., to hold the two halves together. In the exemplary embodiments of FIG. 1, the two halves of the casing 114 are held together by a plurality of rivets 116 spaced around a perimeter of the housing 101. The embodiment of FIGS. 1 and 2 includes three rivets 116 that join the two halves of the casing 114, but it is envisioned that other embodiments may have fewer or greater than three rivets 116.

In FIGS. 1 and 2, the housing 101 includes a fuse carrier 120 that is located above the box lug terminal sub-assembly 102. In the fuse carrier 120, there is a first fuse clip 110, or first electrical contact, disposed proximate a top edge of the fuse holder 100. The tail of the first fuse clip 110 is clamped onto a busbar, while the body of the first fuse clip 110 snaps onto a first end of the fuse cartridge (not shown), thereby making electrical contact with the fuse. The fuse carrier 120 includes a fuse guide 130 configured to push the inserted fuse into the intended vertical orientation when the fuse carrier 120 is closed.

The embodiment of FIGS. 1 and 2 also include a first locating and retaining feature 132 and a second locating and retaining feature 134 for the first fuse clip 110 and second fuse clip 111, respectively. In certain embodiments, the locating and retaining features 132, 134 is in the form of a notch in the fuse clips 110, 111. In a particular embodiment, each of these notches is configured to locate on a projection 135 on the interior of the housing 101. Engagement between these projections 135 on the housing and the notched locating and retaining features 132, 134 serve to fix the location of the fuse clips 110, 111.

The fuse carrier 120 further includes a second fuse clip 111, or second electrical contact, disposed proximate the screw 108. A tail of the second fuse clip 111 is clamped to the wire while the body of the second fuse clip 111 snaps onto a second end of the fuse cartridge opposite the first end, thereby making electrical contact with the fuse. The fuse carrier 120 also includes a pair of reinforcing springs 118 that fit respectively over the two fuse clips 110, 111, which are vertically-separated when the fuse carrier 120 is in the closed position. Thus, it can be seen that the first and second fuse clips 111 are specifically oriented to accommodate a vertically-oriented fuse. The reinforcing springs 118 are configured to provide additional clamp force to help maintain a solid electrical connection between the fuse and the fuse clips 110, 111.

A first snap rib 136 is designed to keep the fuse carrier 120 in the open position. Embodiments of the fuse holder 100 also include a second snap rib 137 (not visible in FIGS. 1 and 2) designed to keep the fuse carrier 120 in the closed position. The first snap rib 136 and second snap rib 137 engage a snap feature 138 on the fuse carrier 120.

The fuse carrier 120 rotates around a pivot 121 located in the housing 101. The fuse carrier 120 rotates back and forth between open and closed positions in order to facilitate the insertion and removal of the fuse. For example, the fuse carrier 120 may be rotated to an open position in which the fuse can be inserted into the fuse carrier 120. When the fuse carrier 120 rotates shut into the closed positon, it snaps the fuse into the two vertically-separated fuse clips 110, 111. A handle 140 allows the user to open and close the fuse carrier 120.

Figure 4:
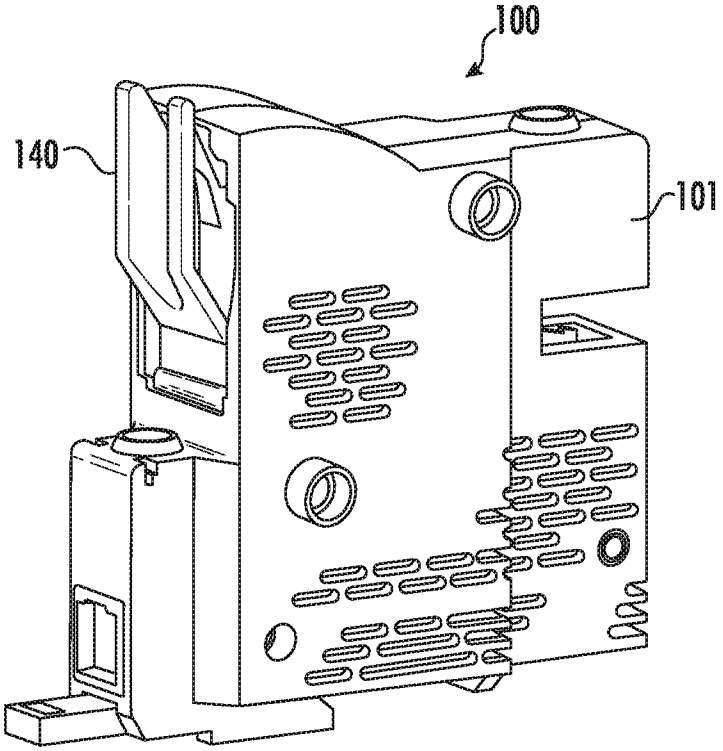
FIGS. 3 and 4 are perspective views of the fuse holder with busbar clamp, in accordance with an embodiment of the invention.
Figure 3:
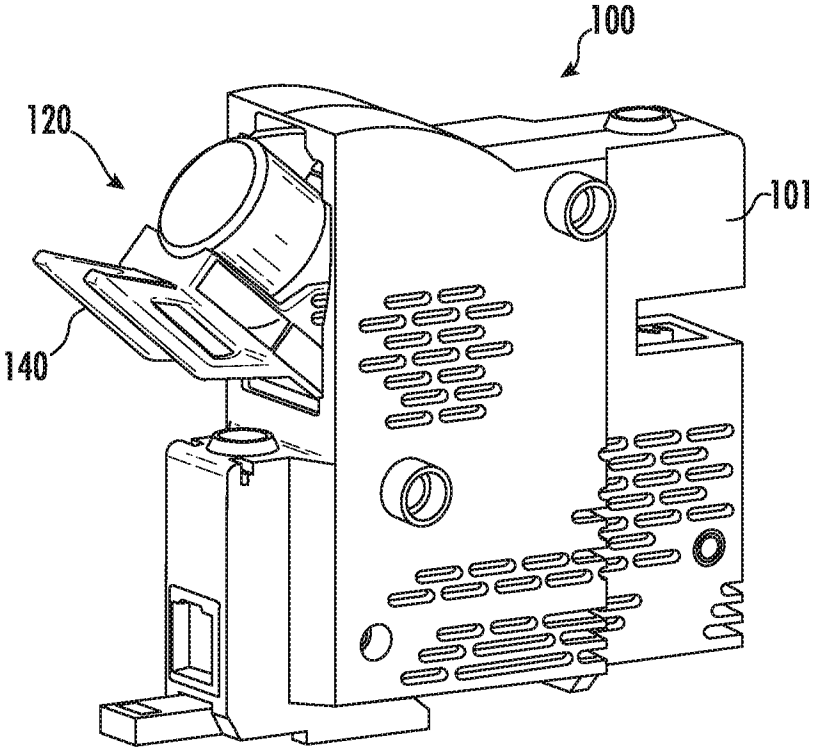

FIGS. 3 and 4 are perspective views of the fuse holder 100, in accordance with an embodiment of the invention. FIG. 3 shows the fuse holder 100 with the fuse carrier 120 open and a fuse inserted, while FIG. 4 shows the fuse holder 100 with the fuse carrier 120 closed. The fuse carrier 120 is closed using handle 140 bringing the fuse into a vertical orientation (or at least into an orientation that is more vertical than horizontal) and bringing the ends of the fuse into electrical contact with the fuse clips 110, 111.

Arranging for the fuse clips 110, 111 and for the fuse to be oriented more vertically than horizontally results in the use of less horizontal space in the fuse panel. If the end-to-end horizontal orientation within the fuse holder is considered to be at zero degrees (when the fuse holder 100 is oriented as shown in FIGS. 1 and 2), being oriented "more vertically than horizontally" means the end-to-end alignment of the fuse is more than 45 degrees from horizontal, where 90 degrees would be solely vertical orientation within the fuse holder. This, in turn, allows for more fuse holders 100 to be installed in a fuse panel of a given size than would be possible using conventional fuse holders.

A busbar clamp sub-assembly 122 includes a second screw 124, a spring plate 126, and a clamp frame 128. It is envisioned that the busbar clamp sub-assembly 122 could be used with busbars of various sizes. For the fuse holder 100 illustrated in FIG. 1, it is expected that the busbar is approximately ¼" thick. In some embodiments, the second screw 124 and the clamp frame 128 are threaded together. When the second screw 124 is torqued, it raises the clamp frame 128 toward the second screw 124, which clamps the busbar to the first fuse clip 110 creating an electrical connection. The spring plate 126 prevents the second screw 124 from digging into the first fuse clip 110.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A fuse holder comprising:

a housing, the housing including a rotating fuse carrier that rotates about a pivot point between open and closed positions, wherein the fuse carrier is configured to accept insertion of a fuse when in the open position, and configured to bring the fuse into electrical contact with a first and a second fuse clip when in the closed position;

wherein the fuse carrier, when in the closed position, is further configured to orient the fuse so that the fuse is positioned more vertically than horizontally;

and further comprising a busbar clamp sub-assembly, which includes a screw threaded into a clamp frame, a spring plate, and the spring plate disposed between the screw and the clamp frame.

2. The fuse holder of claim 1, wherein the fuse carrier rotates about a pivot in the housing.

3. The fuse holder of claim 1, wherein the housing is assembled from two halves.

4. The fuse holder of claim 3, wherein the two halves are joined by one of ultrasonic welding, an adhesive, and one or more mechanical fasteners.

5. The fuse holder of claim 1, wherein the fuse carrier includes a first snap rib that engages with a snap feature to keep the fuse carrier in the open position.

6. The fuse holder of claim 1, wherein the fuse carrier includes a second snap rib that engages with a snap feature to keep the fuse carrier in the closed position.

7. The fuse holder of claim 1, further comprising a DIN rail mount attached to a bottom edge of the housing.

8. The fuse holder of claim 1, further comprising a box lug terminal sub-assembly having a screw threaded into a box lug, and having a relief pad disposed between the screw and one of the first and second fuse clips.

9. The fuse holder of claim 1, wherein at least one of the first and second fuse clips includes a locating and retaining feature configured to fix a location of the at least one of the first and second fuse clips having the locating and retaining feature.

10. The fuse holder of claim 9, wherein the locating and retaining feature is in the form of a notch configured to engage with a projection on the housing.

* * * * *